United States Patent [19]

Thompson et al.

[11] 4,290,093

[45] Sep. 15, 1981

[54] PORTABLE ILLUMINATED MAGAZINE CASE

[75] Inventors: Tom Thompson, Campbell; Kenneth A. Hirschberg, Saratoga, both of Calif.

[73] Assignee: LITE-A-GUIDE, Inc., Los Gatos, Calif.

[21] Appl. No.: 132,254

[22] Filed: Mar. 20, 1980

[51] Int. Cl.[3] ..... F21J 33/00

[52] U.S. Cl. ..... 362/98; 362/184; 362/191; 362/427

[58] Field of Search ..... 362/98, 184, 191, 427

[56] References Cited

U.S. PATENT DOCUMENTS 3,808,415 4/1974 Hurst ..... 362/99 X 3,885,145 5/1975 Wise ..... 362/99

*Primary Examiner*—Stephen J. Lechert, Jr.

*Attorney, Agent, or Firm*—Victor R. Beckman

[57] ABSTRACT

A case for holding an open magazine, or the like, is disclosed comprising a base and cover pivotally attached thereto. The base includes a horizontal flat bottom member of adequate size to support a magazine with the magazine opened to the desired pages. The bottom member is formed with upwardly extending front, rear and opposite side walls, at least the front and opposite side walls of which are of sufficiently low height to avoid interfering with turning and viewing of the magazine pages. A cover is pivotally attached to the case and is movable between open and closed positions. The cover is of a larger size than the base and includes a projecting portion which extends outwardly beyond the base in the closed cover position. The cover includes a flat top member formed with downwardly extending front and opposite side flanges of greater height than the front and opposite walls of the base. A hood, or light shield, is formed at the projecting portion of the cover, which hood extends generally parallel to the top member. Illuminating means comprising a lamp, battery holder and switch are carried by the projecting portion of the cover for illumination of the magazine in the open position of the cover. The illuminating means are hidden from normal direct viewing by the hood. The inner facing surfaces of the cover and hood preferably are of a light color to facilitate reflection of light from the lamp onto the magazine. The switch may be mounted for actuation upon opening and closing of the cover. Stop means between the cover and base prevent opening of the cover beyond a point where gravity closure of the cover is effected. Alternatively, the switch may be manually operable, in which case the stop means may be arranged to allow for pivotal movement of the cover beyond vertical to a position wherein the cover remains open.

16 Claims, 4 Drawing Figures

PORTABLE ILLUMINATED MAGAZINE CASE

BACKGROUND OF THE INVENTION

Illuminated book and pad holders are known as shown, for example, in U.S. Pat. Nos. 3,885,145, to Wise; 1,889,373, Pereira; 1,985,335, Bloss; 1,180,460, Whitney et al; and 1,677,977, Menasco. Also, illuminated lecterns, telephones, and the like, are known as shown in U.S. Pat. Nos. 1,605,843 to Jones; 1,899,499 Ferree et. al.; 1,969,306, Hunter; 1,996,767, Hunter and 1,769,445, Martin. Some of the prior art devices are not readily portable and are, therefore, of limited use. Many are of complicated construction and, consequently, are costly to manufacture. Often, the light source is located so as to direct light across the material to be read, rather than downwardly onto the surface thereof, thereby making viewing difficult. In some prior art arrangements, the source of illumination is not shielded from direct viewing by the user, thereby interfering with viewing of the illuminated material. Many prior art arrangements are not designed for and are incapable of holding a magazine opened to a desired page.

SUMMARY OF THE INVENTION AND OBJECTS

An object of this invention is the provision of a portable case for holding a magazine, or the like, and for illuminating the same when the case is opened, which device avoids the above-mentioned short-comings and disadvantages of prior art arrangements designed for similar use.

An object of this invention is the provision of a portable case for holding a magazine, such as "TV GUIDE" magazine, opened to desired pages which pages are illuminated for viewing in a darkened or dimly lit room upon opening the cover of the case.

An object of this invention is the provision of a neat appearing portable case with electrical illuminating means carried by the cover and normally hidden from direct view in both the cover open and cover closed position.

The above and other objects and advantages of this invention are achieved by use of a case which includes a base which is of adequate size to support a magazine opened to the desired pages. The case is provided with a cover pivotally attached to the base, which cover is of a larger size than the base to include a projecting portion extending outwardly beyond at least one edge of the base. The base includes a horizontal bottom member formed with upwardly extending front and opposite side walls which walls are sufficiently low as not to interfere with viewing and turning pages of the magazine positioned on the bottom member. The cover includes a top member formed with downwardly extending front and opposite side members of greater height than the corresponding front and opposite side walls of the base. A hood, or light shield, is provided at the projecting portion of the cover, which hood extends generally parallel with the top member of the cover. Electrical illuminating means including a battery and battery holder, lamp socket and lamp, and switch, are carried by the cover at the projecting portion thereof adjacent the hood, which lamps are energized when the cover is opened for illumination of the magazine contained in the case. The illuminating means are hidden from direct view during normal use of the apparatus to facilitate reading of the magazine and to avoid detracting from the appearance of the apparatus.

BRIEF DESCRIPTION OF THE DRAWINGS

The invention together with other objects and advantages thereof will be better understood from the following description when considered with the accompanying drawings. In the drawings, wherein like reference characters refer to the same part in the several views.

Figure 1:
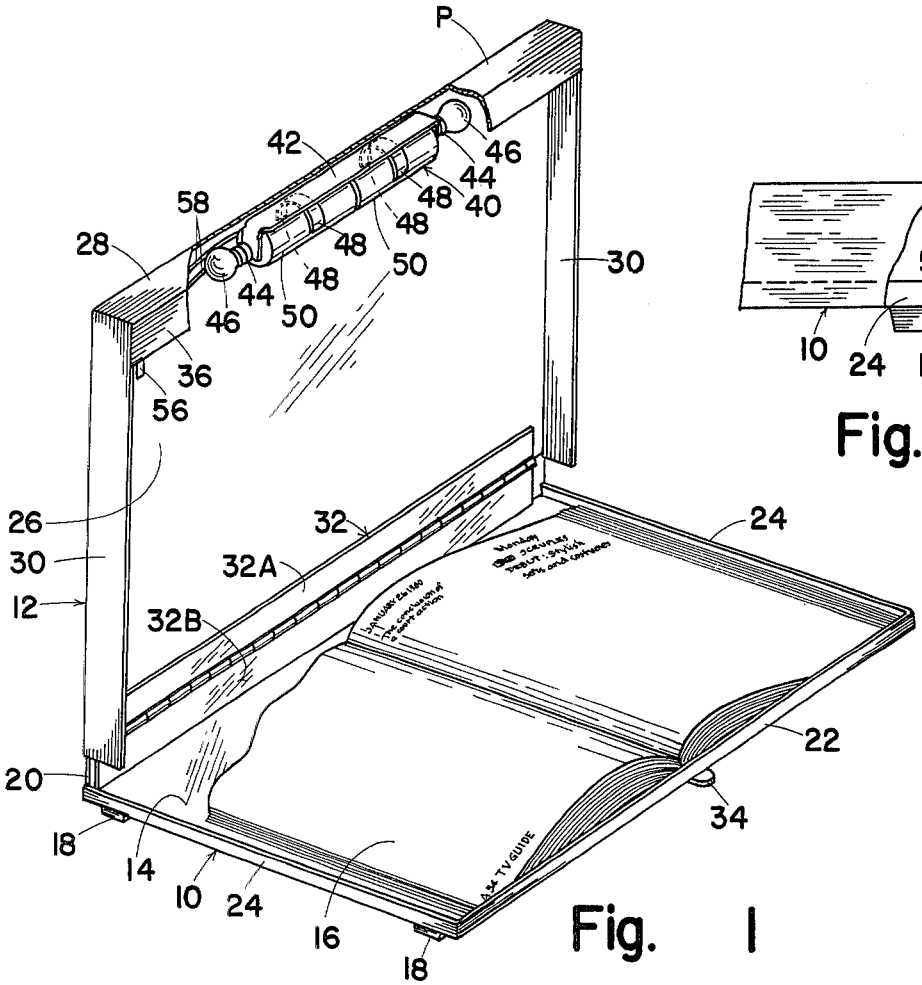
FIG. 1 is an isometric view of a novel portable illuminated magazine case embodying the present invention, with the cover in open position and with portions thereof shown broken away for clarity.
Figure 2:
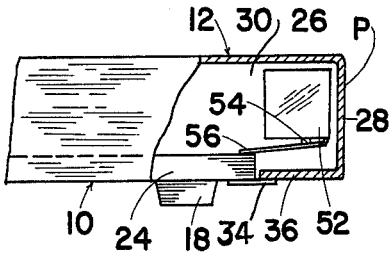
FIG. 2 is a fragmentary side elevational view of the case with the cover in closed position and with a portion thereof shown broken away for clarity.
Figure 3:
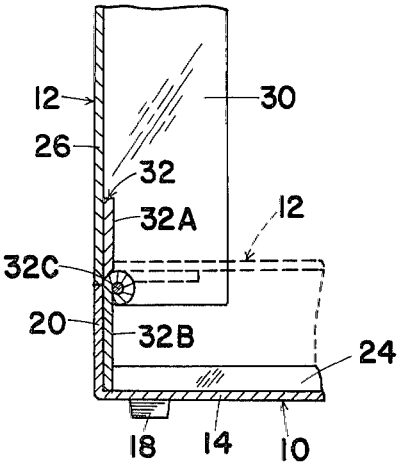
FIG. 3 is a fragmentary sectional view through the case at the hinge showing stop means between the base and cover to limit opening of the cover; the cover being shown closed in the broken line position thereof.

Reference first is made to FIGS. 1–3 of the drawings wherein a novel portable illuminated magazine case which embodies the present invention is shown comprising a base and pivotally attached cover, identified generally by reference numerals 10 and 12, respectively. The base 10 comprises a bottom member 14 of rectangular shape and of a size for support of a magazine 16 in the magazine opened condition. In the illustrated arrangement, a "TV GUIDE" magazine 16, with a portion thereof shown broken away for clarity, is shown in an open position supported on the bottom member. Feet 18 are provided for support of the base 10 a spaced distance above a horizontal supporting surface such as a table top, or the like, to facilitate handling the same.

The bottom member 14 of the base 10 is formed with upwardly directed rear and front walls 20 and 22, respectively, and opposite side walls 24,24. The front wall 22 and opposite side walls 24,24 of the base are of sufficiently low height so as to avoid interfacing with viewing of the magazine 16, or with turning the pages thereof, with the magazine positioned inside the case, as illustrated in FIG. 1.

The cover 20 includes a plane top member 26 formed with a downwardly extending front flange, or wall, 28 and opposite side flanges, or walls, 30,30. A hinge 32 pivotally connects the cover 12 to the base 10, with one hinge element 32A begin secured to the cover 12 along rear edge thereof and the other hinge element 32B being secured to the rear wall 20 of the base. Any suitable means such as welding, riveting, or the like, not shown, may be used for securing the hinge elements to the base and cover. The cover flanges 28 and 30,30 are of substantially greater height than the corresponding base walls 22 and 24,24 and in the closed position of the cover, they overlap the sidewalls of the base and extend a substantial distance thereabove. One or more cover support means are included on the base to support the cover 12 in a position parallel to the base in the cover closed condition. In FIGS. 1 and 2, support means 34 in the form of a forwardly projecting member attached to the bottom member of the base is engaged by a hood 36 formed on the cover for support thereof in the cover closed condition. Obviously, a plurality of such support means may be included for support of the forward projecting portion of the cover at a plurality of points therealong, if desired.

In accordance with the present invention, the cover 12 is of a larger size than the base 10 to thereby provide the cover with a projecting portion which extends outwardly beyond an edge of the base 10 in the cover-closed position. In the illustrated arrangement the cover length i.e. the distance from the front to the rear thereof, exceeds the length of the base and thereby projects forwardly of the base when the cover is closed, as seen in FIG. 2. In FIGS. 1 and 2, the projecting portion of the cover is identified, generally, by the reference character P. For purposes of illustration, but not by way of limitation, the front cover flange 28 may be positioned approximately 1 inch in front of the base front wall 22 in the cover-closed position for a projection of approximately 1 inch.

The above-mentioned hood 36 is formed at the lower edge of the front flange 28 of the cover, and extends rearwardly and generally parallel to the cover top member 26. Electrical illuminating means, identified generally by the reference numeral 40 in FIG. 1, is carried by the cover between the top member 26 and hood 36, adjacent the front cover flange 28 at the projection portion P of the cover. The illustrated illuminating means includes an elongated bracket 42 attached to the inner surface of the flange 28 as by welding, cementing or any suitable fastening means. The bracket 42, which is of a generally U-shaped construction, is provided with lamp sockets 44,44 at the opposite parallel bracket arms for holding lamps, or bulbs, 46,46. Two pairs of resilient, partially cylindrical-shaped, arms 48,48 are formed on the bracket 42 for the removable support of batteries 50,50 therein.

In the embodiment of FIGS. 1–3, the illuminating means 40 includes a switch 52 (FIG. 2) with a set of normally closed contacts. The switch includes an axially movable actuator member 54 and resilient actuator arm 56. It is secured, as by cementing, or other suitable fastening means, not shown, to one of the cover side flanges 30, with a portion of the actuating arm 56 extending rearwardly of the rear edge of the hood. In the cover-closed condition, illustrated in FIG. 2, the actuator arm engages the front wall of the base to open the switch. When the cover is opened, as shown in FIG. 1, the switch contacts are closed to complete the circuit to the lamps 46,46 for energization thereof. Wires 58 (FIG. 1) are included in the connection or the switch to the remainder of the electrical circuit of the illuminating means. The particular electrical circuit employed forms no part of this invention. For example, the lamps 46,46 may be connected in electrical series, or shunt, as may the batteries 50,50, so long as the switch 52 functions to open and close the circuit, as described.

In normal use of the apparatus, the cover 12 is held open, and the illuminated magazine 16 is viewed from an eye level above the cover 12. Consequently, the entire illuminating means 40 (except for the end of switch actuating arm 56) is hidden from view during normal use of the apparatus. The inside surfaces of the cover 12 preferably are formed of, or coated with, a light-reflecting material, such as white paint, or the like, for reflection of light from the lamps 46,46 onto the pages of the magazine to augment direct illumination from the lamps. With the two spaced lamps 46,46, relatively uniform illumination of the magazine pages is provided such that the pages may be read in any ambient light conditions, including total darkness.

With the embodiment illustrated in FIGS. 1–3, wherein the lamps 46,46 are automatically energized upon opening the cover 12, the cover is limited in pivotal movement to a substantially vertically extending open position shown in FIGS. 1 and 3. In this fully open position, the center of gravity of the cover 12 is located to the right of the hinge pin 32C, as viewed in FIG. 3, for pivotal movement thereof under gravity force into the closed position, when the cover is released. As seen in FIG. 3, stop means for preventing further pivotal opening movement of the cover simply comprise the abutting rear edge of the cover top member 26 and upper edge of the base rear wall 20. With the base 10 supported on a substantially horizontal surface, such as a table top, or the top of a television receiver, the cover 12 will assume a closed condition and the lamp circuit is opened. Inadvertent energization of the lamps 46,46 and resulting depletion of the batteries 50,50 is thereby avoided. Of course, the case may be picked up for reading the magazine pages, in which case it may be tilted slightly rearwardly to maintain the cover 12 in the open position without holding the same open.

Figure 4:
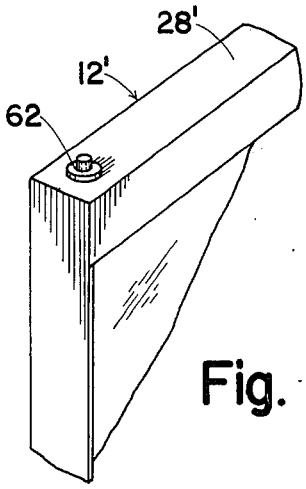
FIG. 4 is a fragmentary isometric view of a corner of a cover of a modified form of this invention employing a manually actuated switch.

The invention having been described in detail in accordance with requirements of the Patent Statutes various changes and modifications will suggest themselves to those skilled in this art. For example, as shown in FIG. 4, a manually actuated push-button switch 62 may be used in place of the switch 52. In FIG. 4, a cover 12' is shown which is the same as cover 12 shown in FIGS. 1–3, but which includes a mounting hole for the switch 62 in the front flange 28' thereof. The switch may be of the momentary type, having normally open contacts which are closed by user actuation thereof. Consequently, the lamps 46, 46 (not shown in FIG. 4) are energized only when the switch actuator is depressed by the user. With this arrangement, the cover may be adapted for pivotal movement beyond the vertical upright position, to a position where it remains open without being held. In another obvious alternative, a simple on-off type switch may be employed which remains in either condition until user actuated. Also, it will be apparent that the cover 12 may be formed with a rear wall of substantially the same height as the front wall 28 and opposite side walls 30,30 thereof, in which case no rear wall 20 would be required on base 10, and the hinge elements 32A and 32B would be attached to said cover rear wall and the bottom member 14 of the base, respectively. It is intended that the above and other such changes and modifications shall fall within the spirit and scope of the invention as defined in the appended claims.

We claim:

1. In a portable magazine case, or the like, with illuminating means for holding an opened magazine, or the like, for enclosing the same and to provide illumination for the pages to which the magazine is opened to facilitate reading the same, the combination comprising a base which includes a bottom member of a size for support of a magazine, or the like, in an opened position, a cover pivotally attached to said base and movable between open and closed positions relative thereto, said cover including a portion which projects beyond at least one edge of the base in the cover closed position, and illuminating means attached to the cover at said projecting portion of said cover for illumination of said base, or magazine positioned thereon, in the open position of the cover.

2. In a portable magazine case, or the like, as defined in claim 1 wherein said cover is pivotally attached to said base along the rear thereof, and the projecting portion of the cover extends forwardly of the front of the base in the cover closed position.

3. In a portable magazine case, or the like, as defined in claim 2 wherein said illuminating means includes a battery holder for holding at least one battery, a lamp socket for at least one lamp, and a switch, each of which battery holder, lamp socket and switch is located at said projecting portion of the cover for movement therewith.

4. In a portable magazine case, or the like, as defined in claim 3 wherein said cover comprises a top member formed with a front wall extending downwardly therefrom in the cover closed position, said illuminating means being located adjacent the inner surface of the cover top member and front wall thereof.

5. In a portable magazine case, or the like, as defined in claim 4 including a hood formed on the front wall of the cover and extending rearwardly thereof for concealing said illuminating means from direct view in normal use of the case.

6. In a portable magazine case, or the like, as defined in claim 3 wherein said switch includes normally closed contacts in electrical circuit with the battery and lamp, and switch actuating means adapted for engagement with said base in the closed condition of the cover for opening the switch contacts to de-energize the lamp in the closed condition of the cover.

7. In a portable magazine case, or the like, as defined in claim 6 including means for preventing pivotal movement of the cover beyond substantially 90 degrees whereby said cover is urged by gravity toward the closed position thereof in all cover positions when the base is substantially horizontally supported.

8. In a portable magazine case, or the like, as defined in claim 3 wherein said switch includes normally open contacts in electrical circuit with the battery and lamp, and manually movable switch actuating means extending through an aperture in said cover for manual closure of the switch contacts by the user.

9. In a portable magazine case, or the like, as defined in claim 1 wherein said cover comprises a top member and a front wall extending downwardly from the top member in the cover closed position, and said base including generally upright front and opposite side walls which are of substantially less height than the height of the cover front wall.

10. In a portable magazine case, or the like, as defined in claim 9 including stop means extending from said base and engagable by the projecting portion of said cover for limiting pivotal movement of the cover in the cover closed position.

11. In a portable magazine case, or the like, as defined in claim 10 wherein said stop means extends forwardly from the bottom member of said base.

12. In a portable magazine case, or the like, as defined in claim 11 including a hood at the front wall of said cover and extending rearwardly therefrom for concealing said illuminating means from direct view in normal use of the case, said hood being engageable with said stop means in the cover closed position.

13. In a portable magazine case, or the like, as defined in claim 1 including feet at the bottom of said base for support of the base a spaced distance above a supporting surface.

14. In a combination portable magazine case for holding a magazine in open position for enclosing the same and illuminating means for illumination of the pages to which the magazine is opened to facilitate reading the same, the combination comprising a base which includes a bottom member adapted for support of a magazine in open position, means for supporting said base on a horizontal supporting surface, a cover, means for pivotally attaching said cover to said base for pivotal movement of the cover between an open upright position and closed substantially horizontal position, said cover being formed with a projecting portion which extends forwardly of the front of said base in the cover closed position, a light shield at the projecting portion of said cover, and illuminating means at the cover between the projection portion thereof and light shield for illuminating the bottom member of said base in the cover open position.

15. In a combination as defined in claim 14 including a magazine in open position supported on the bottom member of said base for illumination by said illuminating means in the cover open position.

16. In a combination as defined in claim 14 including means for preventing pivotal movement of said cover beyond substantially 90 degrees whereby said cover is urged by gravity toward the closed position thereof in all cover positions with the base in a horizontal position.

* * * * *